United States Patent [19]

Aring

[11] 3,974,793

[45] Aug. 17, 1976

[54] ANCHOR CRADLE APPARATUS FOR HANDLING AND STOWING AN ANCHOR

[75] Inventor: John Alan Aring, Renton, Wash.

[73] Assignee: The Boeing Company, Seattle, Wash.

[22] Filed: July 8, 1975

[21] Appl. No.: 594,170

[52] U.S. Cl. ..... 114/210

[51] Int. Cl.[2] ..... B63B 21/22

[58] Field of Search ..... 114/206 R, 207, 208 R, 114/210; 254/190 R, 192

[56] References Cited

UNITED STATES PATENTS

| | | | |
|---|---|---|---|
| 1,640,672 | 8/1927 | Schauman | 114/210 |
| 2,931,331 | 4/1960 | Uebelhoer | 114/210 |
| 2,954,004 | 9/1960 | Evans, Jr. | 114/210 |
| 3,074,370 | 1/1963 | Seiger | 114/210 |
| 3,158,128 | 11/1964 | Sarns | 114/210 |
| 3,785,323 | 1/1974 | Lantz | 114/210 |

*Primary Examiner*—Trygve M. Blix
*Assistant Examiner*—Jesus D. Sotelo
*Attorney, Agent, or Firm*—Nicolaas DeVogel; Kenneth W. Thomas

[57] ABSTRACT

An anchor cradle unit which restrains an anchor in a folded flat horizontal position on a deck. The cradle is pivotally mounted at the deck edge and adapted to be positioned by a controlled force about the pivot so that the cradle extends at a predetermined angle beyond the deck edge. Upon predetermined release of the anchor from the cradle, the anchor will swing away from the cradle and drop by gravity. Upon stowing, the anchor will be raised and connectedly received in scabbards against the cradle, pivoted therewith onto the deck and thereafter secured to the cradle.

4 Claims, 7 Drawing Figures

ANCHOR CRADLE APPARATUS FOR HANDLING AND STOWING AN ANCHOR

STATEMENT OF GOVERNMENT INTEREST

The invention described herein may be manufactured by or for the Government of the United States of America for governmental purposes without the payment of any royalties thereon or therefor.

BACKGROUND OF THE INVENTION

The construction of the present invention generally comprises a niche or cradle into which the anchor is housed, a force actuating means to pivot the cradle, and connecting links for levering the cradle and supporting the same at an outboard extended position. However, the combination of the above elements with its specific design details solves the requirements which are not present in conventional anchor-handling equipment.

These requirements are:

1. to have an anchor stowed on the deck in a flat secured position;
2. to be able to drop the anchor during stamping and pitching ship conditions in a completely controlled mode;
3. to position the anchor clear from the deck edge and appendages;
4. to be able to drop the anchor when the correct deck-to-sea-surface angle appears;
5. to easily recover the anchor back onto the deck without hitting the same, and
6. thereafter stowing the anchor in a controlled mode.

It should be understood that under "controlled mode" is meant the absence of the effects of gravity or other uncontrolled forces; for instance, the inertial forces caused by the heavy anchor.

The presently disclosed invention is specifically designed in accordance with the above requirements.

The most pertinent art found in a patent search showed the following patents: U.S. Pats. Nos. 1,636,944, 1,640,672, 2,333,836, 2,940,413, 2,975,748, 3,186,373.

As will be noted, the basic construction of a davit means which carries an anchor is well known; however, the particular way of moving a deck anchor in position in a controlled mode is not disclosed since all of the existing art is gravity operated, where the weight of the anchor is essential. Furthermore, the mechanisms are complex, sometimes bulky, and projecting above or underneath the deck. In general but most important, none of the prior art devices can be safely and efficiently operated when the ship is pitching. The basic concept as proposed by the above-mentioned prior art relies on allowing the anchor due to its appreciable weight to exert the required inertial force to flop it overboard about its pivot points.

SUMMARY OF INVENTION

The invention comprises a cradle structure in which the anchor is fastened by temporary latch or rope means and stowed fastening means. The cradle is pivotally mounted along the deck edge and an actuator connected to a power source is capable of pivoting the cradle after the stowed fastening means are released with its temporary fastened anchor upright to an overdeck slanted position. Thereupon, manually unfastening of the anchor temporary fastening means at the correct moment will allow the anchor to fall free from the ship structure.

The present anchor-handling device was primarily designed for a hydrofoil ship. A hydrofoil ship has forward strut means with submerged horizontally extending foils generally directly below the bow of the boat. The problem experienced by hydrofoil captains is that the anchor-dropping procedure causes the anchor to fall on the foils or the chain or anchor rope to get hung up about the strut or foil, in particular when the hydrofoil is in a heavy-sea state and the deck anchor can fall in any direction when using conventional anchor-handling equipment. The proper dropping moment from a hydrofoil bow deck would be the release of the anchor when the boat pitches downwards with its bow into or toward the sea waves. In this case the foils are at the largest angle away from an imaginary vertical line between bow and sea and the foils are located astern of the bow. Of course, the same procedure will apply for the stern, port and/or starboard sides of a ship. However, since the problem of dropping a deck anchor from a hydrofoil has been solved by keeping the anchor in a completely controlled position at all times, it became evident that the present invention is applicable to other craft using deck anchors as well, solves the general problem of handling ease, and offers the advantage of the simple and compact cradle anchor holding and mounting means. In addition, the anchor dropping and retrieving procedure can be performed without the risk of hitting and damaging the ship hull or other appendages.

Accordingly, one of the most serious problems the present anchor-handling device solves is the complete safety in raising the anchor and the proper positioning thereof for dropping the anchor from a heavily pitching deck.

The other problem solved is the retrieval of the anchor under similar deck-pitching conditions whereby the chances of hitting the deck or other appendages is practically eliminated.

In essence, the present invention provides for a completely controlled handling of the anchor, independent of gravity or shocks, etc., from stowing flat, to positioning for drop or vice versa.

In general, the concept embodies an anchor-handling apparatus for a ship having a deck anchor, which includes a cradle structure having a substantially flat triangular configuration which in an anchor-stowed position is disposed in flat relationship to the deck with its triangular base substantially parallel and next to the deck edge, and its apex farthest away from the deck edge. Furthermore, there are pivot means mounted to the deck and connected to the cradle structure along the base for pivoting the cradle upwards towards an outboard erected position, so that power actuator means mounted between the deck and the cradle structure can erect or collapse the cradle structure from the flat disposed position to the outboard erected position and vice versa. Certain holding means connected to the cradle structure are employed for receiving and retaining the anchor by its flukes, and pulley means are mounted at the apex for guiding the associated anchor chain and cable power means. For anchor dropping purposes there are means for temporarily retaining the anchor to the cradle and for affording immediate release of the anchor from the cradle. In the preferred embodiment there is also a bracing means comprising foldable links mounted between the cradle and the deck so that the cradle will assume a predetermined outboard angle when in the outboard erected position. For guiding the anchor into the stowed position, the pivot means are provided with cam surfaces to guide the anchor stock, which cams end in hook means to entrap the anchor in position so that permanent tension fitting means near the anchor eye can fasten the anchor in stowed position.

DESCRIPTION OF THE INVENTION

Figure 1:
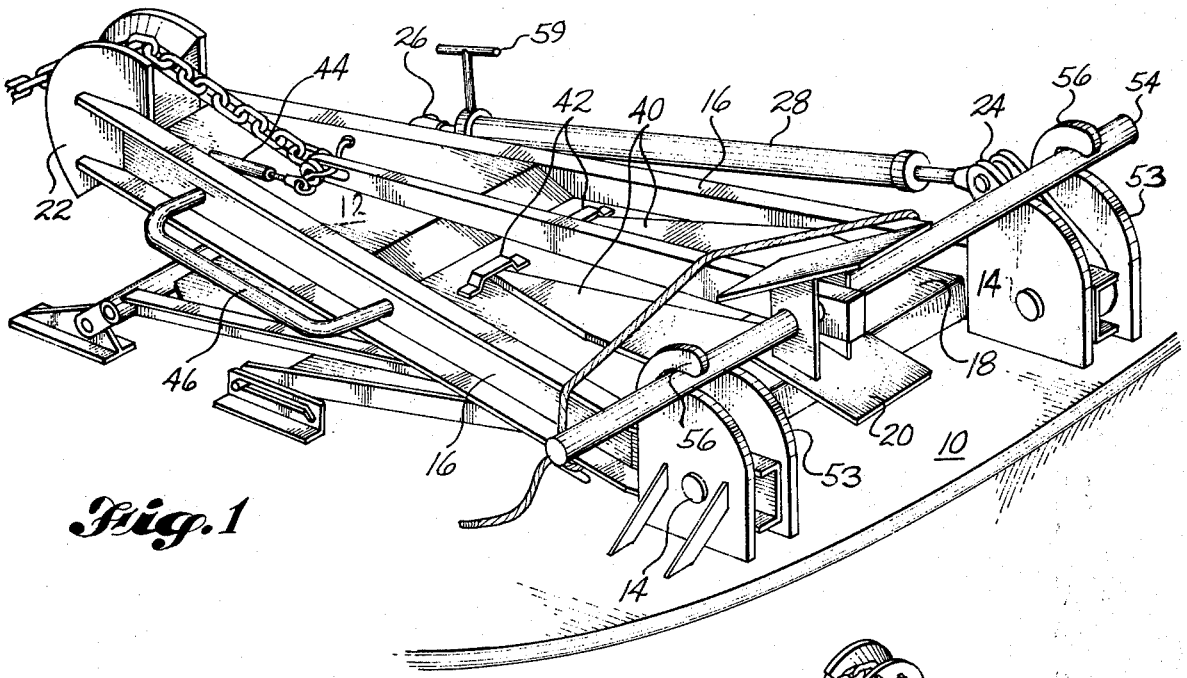
FIG. 1 is a perspective front view of the anchor cradle and secured anchor on a boat deck stowed in a flat position.
Figure 7:
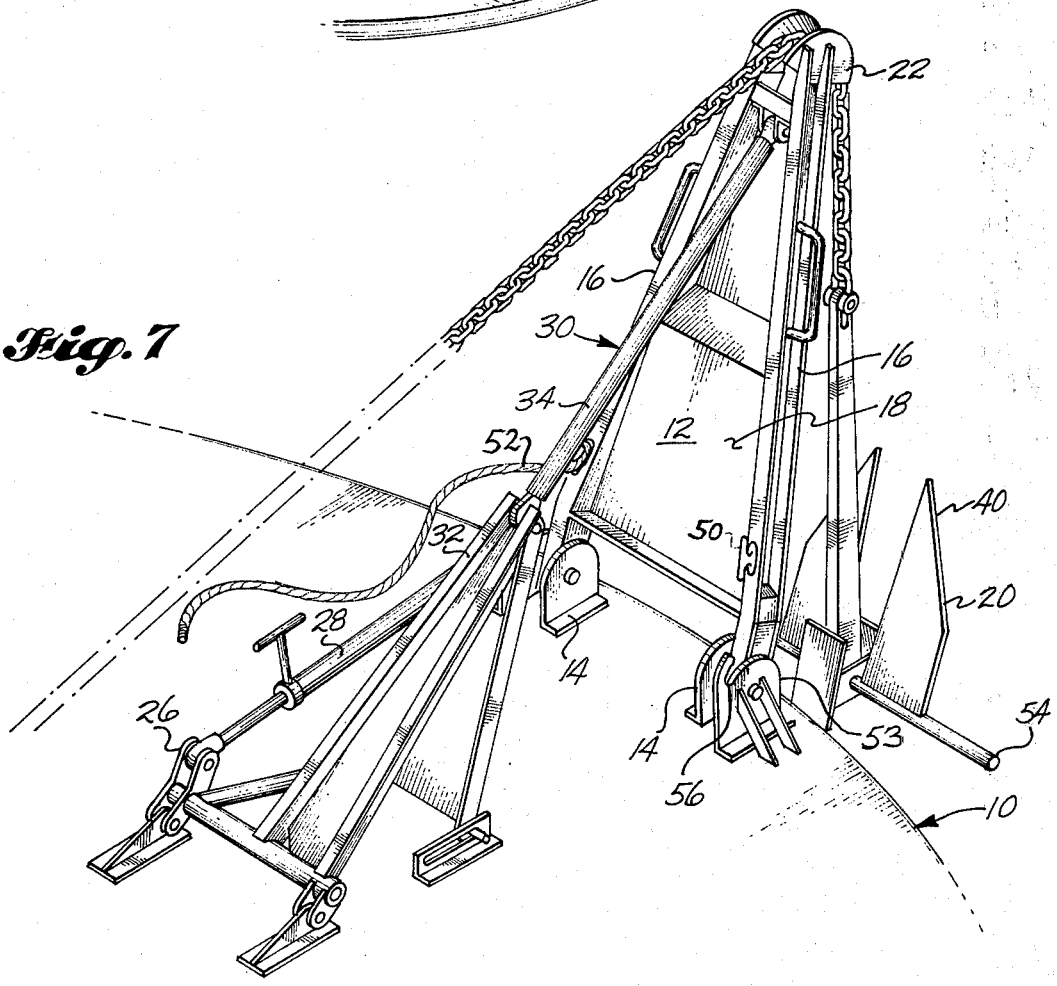
FIG. 7 is a perspective rear view of the anchor cradle apparatus in the deployed position, similar to FIG. 5.
Figure 2:
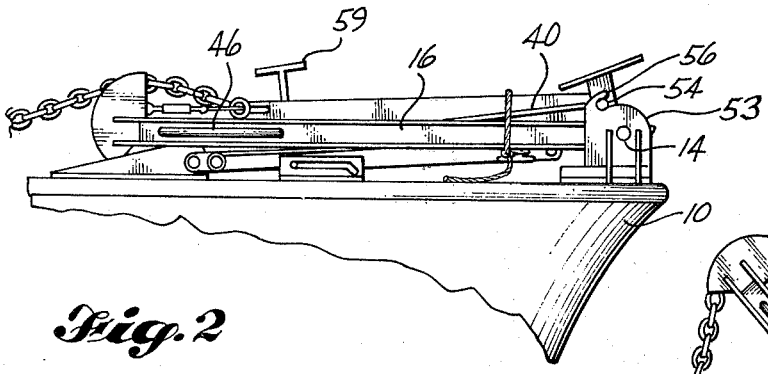
FIGS. 2–5 are simplified side elevations of the anchor-handling apparatus in the stowed, intermediate, erected and deployed positions, respectively, in calm sea state condition.
Figure 3:
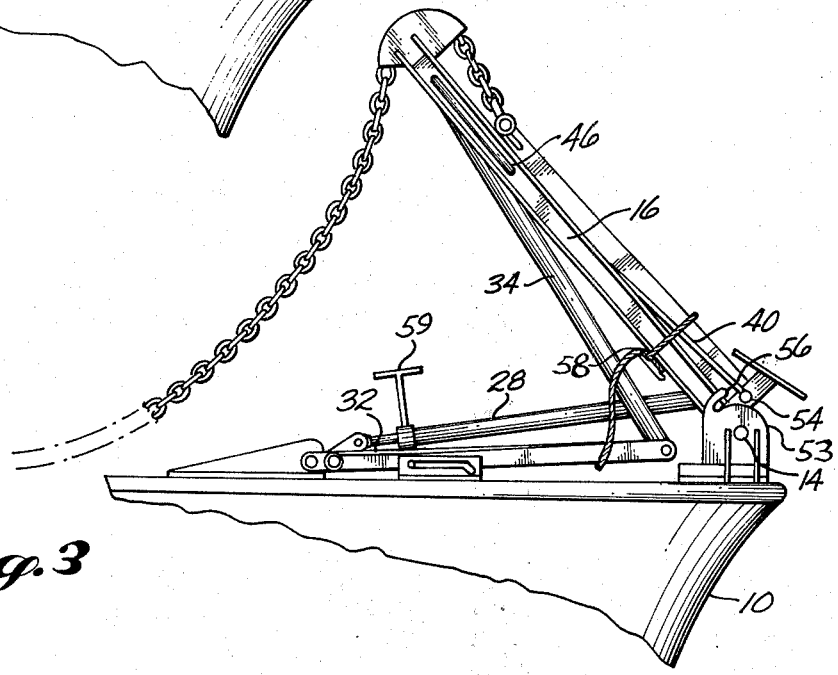
Figure 4:
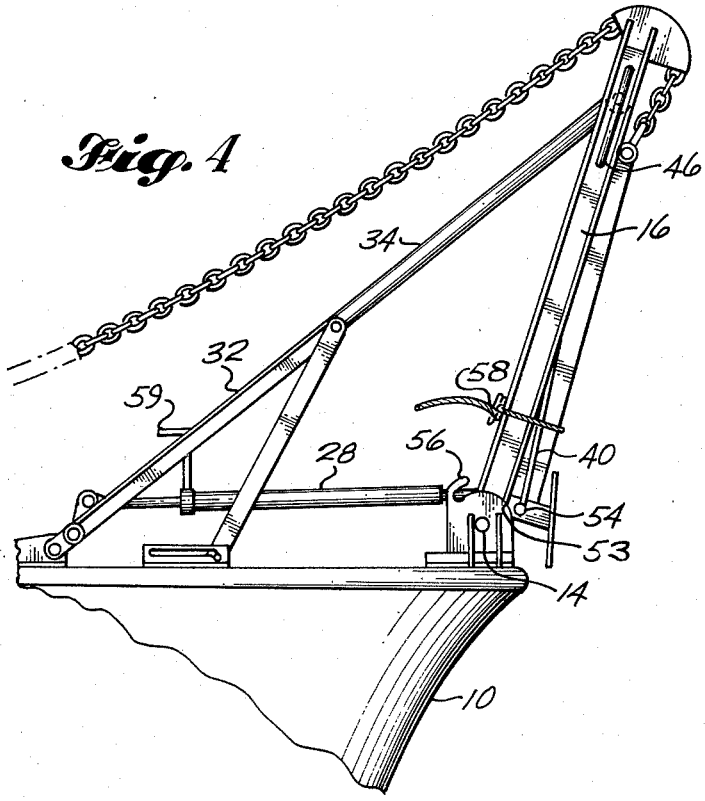
Figure 5:
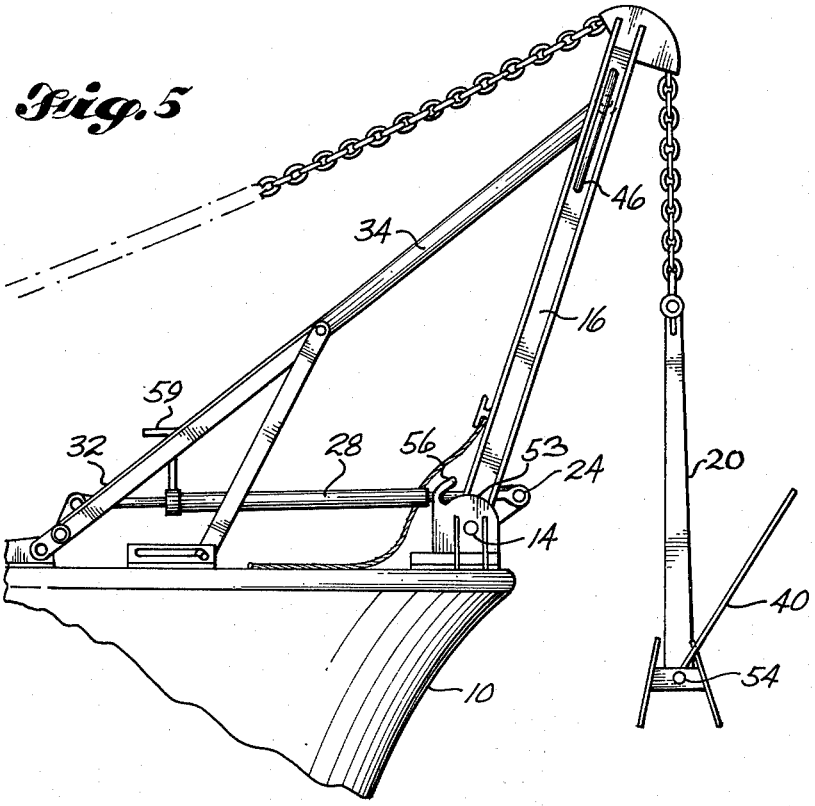

Referring to the drawings, in particular FIGS. 1 and 7, in which similar reference numerals refer to like parts, the reference numeral 10 indicates the forward deck of a ship.

At the deck edge, a cradle structure 12, having a substantially triangular configuration, is pivotally connected by spaced pivot means 14 mounted permanently to the deck 10.

The cradle 12 comprises two beams 16 interconnected by a support means such as a web 18 which assembly forms a niche or cradle in which an associate anchor 20 is received.

The two beams 16 are pivotally connected to the spaced pivot means 14 at one end and at the other end form a junction containing a fairlead or pulley arrangement 22.

At least one of the structural beams 16 has a pivot lug 24 which is located at an offset point from pivot means 14 and at a perpendicular distance away from the longitudinal axis of the beam in order to accomplish a leverage for a power force for raising and lowering the cradle structure.

Another deck pivot lug 26 is mounted at a predetermined inboard location away from the deck edge. Between the pivot lug 24 and the deck pivot lug 26 is a power actuator means 28 connected which upon actuation of the T-handle 59 will expand and rotate the cradle 12 in an erected position in reference to the deck 10. Accordingly, the cradle 12 will rotate about the pivot points 14 and assumes the consecutive positions as illustrated in FIGS. 2 through 5.

A brace means 30, such as a series of structural collapsible, telescoping or foldable links 32 and 34 are mounted between the cradle 12 and the deck 10 so that the cradle can rotate rigidly along a predetermined arc, forming an angle between deck and cradle of about 120-135 degrees.

As shown in FIG. 1, the anchor 20 is held by its flukes 40 into scabbards or hook means 42 which are mounted on the web 18. In addition, there is a permanent fastening means 44, such as a tension fitting or the like, provided at the cradle 12 for holding the anchor 20 in a folded-down stowed position. For instance, during a voyage when the anchor is stowed and secured by the tension fitting 44, the anchor chain can be disconnected from the anchor eye and stored on the winch, thus preventing the conventional rattling noises which is an additional advantage of the device.

In the event the power actuating means 28 fails to operate, manual holding means 46 are mounted at the sides of the beams 16 for manually raising the cradle 12 in an erected position.

For anchor release purposes there are horn cleats 50 provided at the underside or deckside of the beams 16. The cleats 50 have a double function in the anchor dropping or retrieval procedure.

In the anchor dropping procedure the cleats 50 hold a temporary retaining means or lashing line 52 or the like which hold the anchor 20 in the cradle 12 when the cradle is in the upright position. Removal of the lashing line 52, which is accomplished by one manual pull, will cause the anchor to slide out of the scabbards and away from the cradle 12. Of course the lashing line 52 holds the anchor 20 by a quick release or slip knot 58 so that immediate release of the anchor 20 is accomplished.

Figure 6:
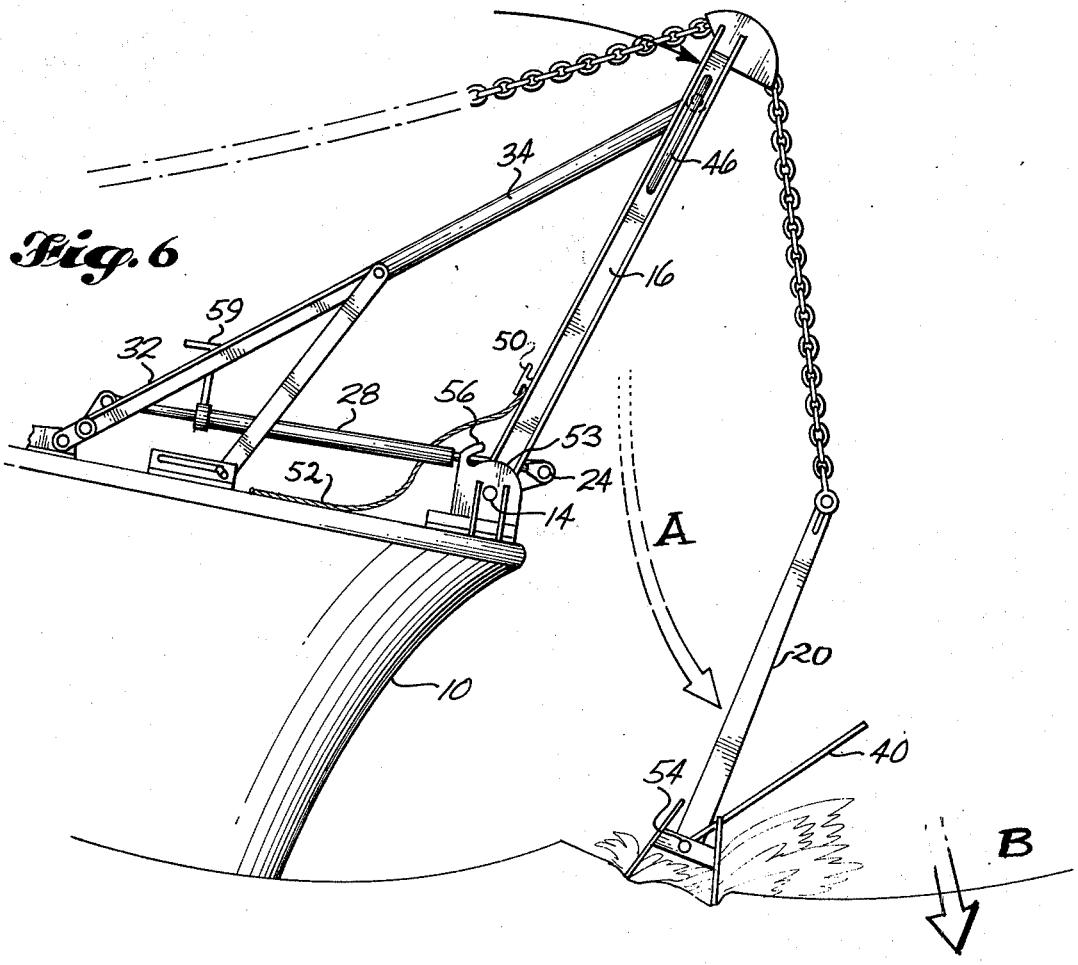
FIG. 6 is a schematic view of dropping the anchor at the correct bow-sea wave position from a hydrofoil bow deck when a rough sea state prevails.

Referring now in particular to FIG. 6 it will be noticed that at the moment that the deck pitches downward the release of the lashing line 52 should take place so that the anchor flukes 40 will slide out of the scabbards 42 and the anchor follows the direction of the arrow A by swinging away from the deck 10 and diving into the water as projected by arrow B.

The release of the lashing line 52 thus provides the operator with the opportunity to drop the anchor 20 completely at his will, free and away from the ship's deck and other appendages.

In the retrieval procedure the lashing line 52 is used to draw the suspended anchor 20 up to the cradle 12 and assist in guiding the anchor flukes 40 into the scabbards 42. The positioning of the anchor flukes 40 onto the cradle 12 is assisted by the guidance feature of the cams 53 and anchor stock 54, which are in contact as soon as the anchor is raised and the cradle moves towards its stowing flat position. Furthermore, the cams 53 end into a hook-shaped portion 56 which entraps the anchor for permanent fastening and stowing in coordination with the fastening means 44 located near the upper anchor shaft or near the anchor eye.

In summary, the present invention provides for the stowing of a deck anchor in a noiseless, tight secured arrangement and allows the positioning of the anchor for dropping at the operator's will. The cradle raising from the stowed to the drop position is independent of the stamping and shocking forces endured by the ship and other gravity effects. The dropping of the anchor can be effected away from the ship through the control of the operator.

While there has been described what is at present considered to be the preferred embodiment of this invention, it will be obvious to those skilled in the art that various changes and modifications may be made therein without departing from the invention, and it is, therefore, aimed in the appended claims to cover all such changes and modifications as fall within the true spirit and scope of the invention.

Now, therefor, I claim:

1. An anchor-handling apparatus for a ship utilizing a deck anchor, comprising in combination:

a. a cradle structure pivotally mounted by pivot means along the ship's deck edge;

b. said cradle structure provided with holding means for holding said deck anchor when positioned in said cradle; said holding means including:

1. permanent retaining means such as a tension fitting connectedly engaging said cradle with said anchor and 2. hook means holding said anchor flukes in slideable connection to said cradle;

c. power-actuating means connected to said cradle for raising and lowering said cradle about said pivot means from a stowed flat deck position to an outboard slanted erected position and vice versa;

d. temporary retaining means such as a lashing line or the like for keeping said anchor to said cradle and for providing immediate dropping release of said anchor from said cradle in said slanted position when desired;

e. collapsible brace means connected between said deck and said cradle for holding and supporting said cradle in a predetermined angle when in said slanted outboard position, and f. said pivot means provided with a cam surface for guiding said anchor by its anchor stock from and on said cradle in said cradle raising and lowering movements respectively, and said cam means provided with a hook portion to entrap said anchor stock for permanent fastening of said anchor in its stowed condition by said tension fitting means.

2. An anchor-handling apparatus for a ship having a deck anchor, comprising in combination:

a. a cradle structure having a substantially flat triangular configuration which in an anchor-stowed position is disposed in flat relationship to said deck with its triangular base substantially parallel and next to said deck edge, and its apex furthest away from said deck edge;

b. said cradle structure provided with anchor holding means;

c. pivot means mounted to said deck and connected to said cradle structure along said base for pivoting said cradle upwards towards an outboard erected position;

d. power actuator means mounted between said deck and said cradle structure for erecting and collapsing said cradle structure from said flat disposed position to said outboard erected position and vice versa;

e. pulley means mounted at said apex for guiding associated anchor chain;

f. means for temporarily retaining said anchor to said cradle and for affording immediate dropping release of said anchor from said cradle in said erected cradle position;

g. collapsible bracing means mounted between said deck and said cradle for retaining said cradle in a predetermined outboard slanted angle when said cradle is raised by said power actuator means; and h. said pivot means provided with cam surfaces ending into a hook portion and whereby said cam surfaces cooperate in guiding said anchor by its anchor stock on and from said cradle during said anchor retrieval and said anchor dropping respectively and whereby said hook portion engages with said anchor stock in said anchor-stowing condition so that said anchor holding means enables the securing of said anchor in said cradle in its stowed position.

3. An anchor-handling apparatus as claimed in claim 2 wherein holding means such as scabbards are connected to said cradle structure for slideably receiving and retaining said anchor in correct position on said cradle by said anchor flukes.

4. An anchor-handling apparatus as claimed in claim 3 wherein said collapsible brace means holds said anchor cradle within a 120°–135° angle between deck surface and cradle when in said erect outboard slanted position.

* * * * *